US007351164B2

(12) United States Patent
Schweigert et al.

(10) Patent No.: US 7,351,164 B2
(45) **Date of Patent: *Apr. 1, 2008**

(54) IRON-TYPE GOLF CLUB HEAD

(75) Inventors: Bradley D. Schweigert, Anthem, AZ (US); Michael R. Nicolette, Scottsdale, AZ (US); John A. Solheim, Phoenix, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 369 days.

This patent is subject to a terminal disclaimer.

(21) Appl. No.: 11/195,444

(22) Filed: Aug. 1, 2005

(65) Prior Publication Data

US 2007/0026967 A1 Feb. 1, 2007

(51) Int. Cl.
*A63B 53/04* (2006.01)

(52) U.S. Cl. ..... 473/349; 473/350

(58) Field of Classification Search ..... 473/324–350, 473/287–292; D21/747–752, 759
See application file for complete search history.

(56) References Cited

U.S. PATENT DOCUMENTS

| | | | | |
|---|---|---|---|---|
| 4,326,326 | A | 4/1982 | MacDonald | |
| 4,715,601 | A * | 12/1987 | Lamanna | 473/291 |
| 4,754,977 | A | 7/1988 | Sahm | |
| 4,883,274 | A | 11/1989 | Hsien | |
| 5,014,993 | A | 5/1991 | Antonious | |
| 5,082,278 | A * | 1/1992 | Hsien | 473/242 |
| 5,333,872 | A * | 8/1994 | Manning et al. | 473/291 |
| 5,447,307 | A * | 9/1995 | Antonious | 473/350 |
| 5,549,297 | A * | 8/1996 | Mahaffey | 473/290 |
| 5,921,869 | A * | 7/1999 | Blough et al. | 473/291 |
| D437,625 | S | 2/2001 | Turner | |
| 6,206,790 | B1 | 3/2001 | Kubica | |
| 6,210,290 | B1 | 4/2001 | Erickson | |
| 6,290,609 | B1 * | 9/2001 | Takeda | 473/335 |
| 6,450,897 | B2 * | 9/2002 | Stites et al. | 473/334 |
| 6,743,114 | B2 * | 6/2004 | Best | 473/291 |
| 6,835,144 | B2 | 12/2004 | Best | |
| 6,849,005 | B2 * | 2/2005 | Rife | 473/350 |
| D530,759 | S * | 10/2006 | Nicolette et al. | D21/749 |
| D534,228 | S * | 12/2006 | Nicolette et al. | D21/749 |
| D534,597 | S * | 1/2007 | Nicolette et al. | D21/749 |
| D538,366 | S * | 3/2007 | Nicolette et al. | D21/748 |
| D541,360 | S * | 4/2007 | Schweigert et al. | D21/747 |
| 7,207,900 | B2 * | 4/2007 | Nicolette et al. | 473/334 |
| 2001/0001774 | A1 | 5/2001 | Antonious | |
| 2001/0014628 | A1 * | 8/2001 | Erickson et al. | 473/334 |
| 2005/0009632 | A1 * | 1/2005 | Schweigert et al. | 473/345 |
| 2005/0239572 | A1 * | 10/2005 | Roach et al. | 473/332 |
| 2007/0042834 | A1 * | 2/2007 | Nicolette et al. | 473/334 |

FOREIGN PATENT DOCUMENTS

| | | |
|---|---|---|
| GB | 2310379 | 8/1997 |
| GB | 2321201 | 7/1998 |
| GB | 2403659 | 12/2005 |
| JP | 2000126337 | 10/1998 |
| JP | 2001087430 | 9/1999 |

* cited by examiner

*Primary Examiner*—Sebastiano Passaniti
(74) *Attorney, Agent, or Firm*—Darrell F. Marquette

(57) ABSTRACT

The present invention provides an iron-type golf club head comprising a primary cavity that is approximately parallel to the ground when the club head is resting at normal address. A secondary cavity, positioned within the primary cavity, has a bottom wall that is approximately parallel to the club face and is positioned above the club head sole. An interior wall that forms the secondary cavity is uniform in height while increasing in width in a bottom segment thereof.

20 Claims, 4 Drawing Sheets

IRON-TYPE GOLF CLUB HEAD

BACKGROUND OF THE INVENTION

The present invention relates generally to golf equipment and, in particular, to an iron-type golf club head.

Over the past several years, golf club designers have attempted to improve iron-type golf club heads by, for example, lowering the center of gravity, minimizing unwanted vibration, and/or generally enhancing feel. For example, polymeric weighting elements disposed in the backside of "cavity-backed" iron heads have been employed in an attempt to achieve such attributes. While such designs have accomplished a certain level of success in lowering the center of gravity, minimizing unwanted vibration, and/or enhancing feel, the dimensions and placement of such weighting elements (and the geometry of the perimeter weighting elements that, in part, form such "cavity-backed" iron heads) have not been fully optimized. Thus, a need exists for iron-type golf club heads which comprise improved perimeter weighting characteristics and enhanced positioning of weighting elements disposed in the backside of such golf club heads.

SUMMARY OF THE INVENTION

According to a first aspect of the present invention, an iron-type golf club head is provided, which comprises a primary cavity formed by at least one perimeter weighting element and a secondary cavity formed by an interior wall positioned within the primary cavity. Preferably, the interior wall is approximately uniform in height (i.e., from the bottom wall of the primary cavity to the top of the interior wall). In certain embodiments, the interior wall comprises a top segment which is approximately uniform in width. According to another aspect of the invention, the interior wall further comprises a pair of bottom segments which are integral with the sole of the golf club head and, preferably, increases in width as they approach the sole.

According to a further aspect of the present invention, an iron-type golf club head is provided that comprises: (a) a front face arranged for impacting a golf ball; (b) a primary cavity formed by at least one perimeter weighting element, wherein such perimeter weighting element comprises a top rail and a bottom rail; and (c) a secondary cavity formed by an interior wall positioned within the primary cavity, wherein such interior wall comprises a top segment and a pair of bottom segments. In certain preferred embodiments, the top and bottom rails of the perimeter weighting element preferably each have a surface that faces the interior of the primary cavity, wherein either (or both) of such surfaces is preferably approximately parallel to the ground when the golf club head is resting at normal address. In other words, a line that runs tangential along the interior surface of, for example, the center portion of the bottom rail is approximately parallel to the ground when the club head is at address.

In such preferred embodiments, the secondary cavity has a bottom wall that is preferably approximately parallel to the plane of the front face. In such embodiments, the secondary cavity bottom wall is preferably approximately equal distance from the front face at the heel and toe ends of the secondary cavity.

DESCRIPTION OF THE INVENTION

Figure 1:
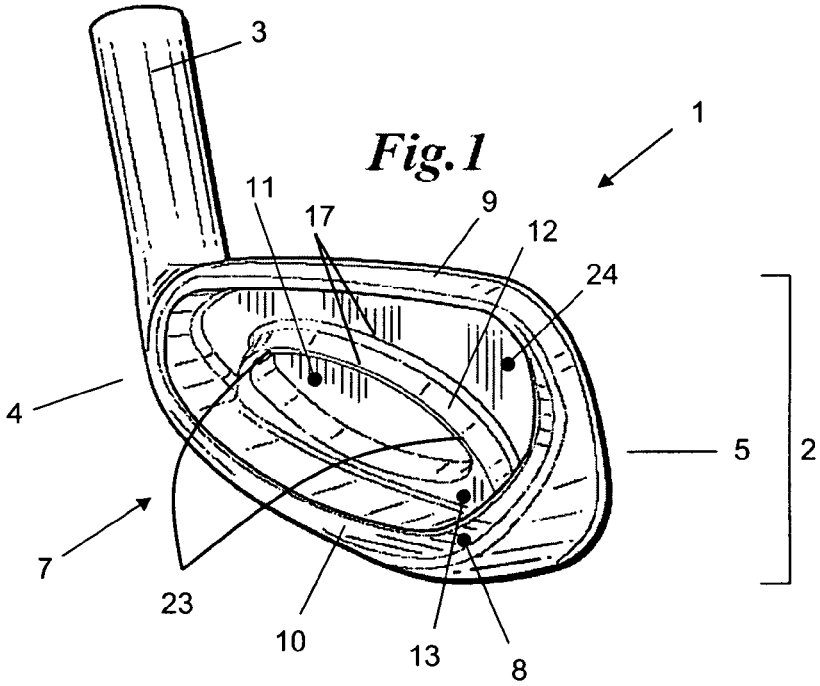
FIG. 1 is a perspective view of a golf club head according to the present invention.

Referring to FIGS. 1-11, an iron-type golf club head 1 includes a body 2 and a hosel 3 for receiving one end of a shaft (not shown). The body 2 has a heel end 4 and a toe end 5. The club head 1 has a front face 6 arranged for impacting a golf ball, which extends between the heel and toe ends 4, 5. The front face 6 is, preferably, provided with a plurality of grooves.

In addition, the club head 1 has a backside 7 opposite the front face 6. The backside 7 of the club head 1 in the present invention comprises a primary cavity formed by a perimeter weighting element 8. The perimeter weighting element 8, preferably, protrudes rearwardly away from the front face 6 of the club head 1, which defines the primary cavity in the backside 7 of the club head 1. The perimeter weighting element 8, typically, includes a top rail 9 and a bottom rail (or "sole") 10. The primary cavity is therefore defined at its upper extremity by the top rail 9 and at its lower extremity by the bottom rail (or "sole") 10. The top rail 9 extends between the body heel 4 and toe 5 portions along an upper portion of the body 2, whereas the sole 10 extends between the body heel 4 and toe 5 portions along the lower portion of the body 2.

Figure 5:
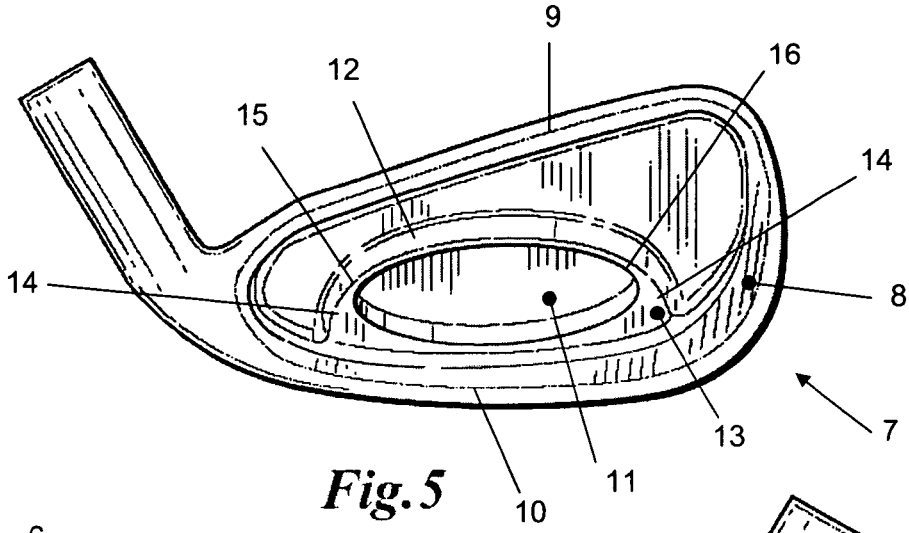
FIG. 5 is a rear elevational view of the golf club head shown in FIG. 1.
Figure 6:
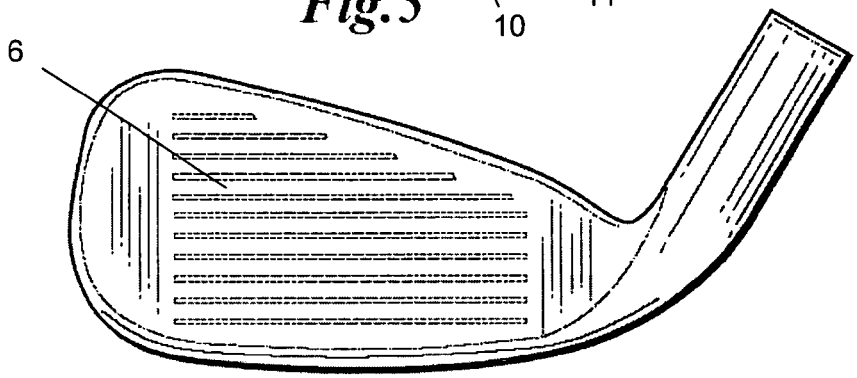
FIG. 6 is a front elevational view of the golf club head shown in FIG. 1.
Figure 7:
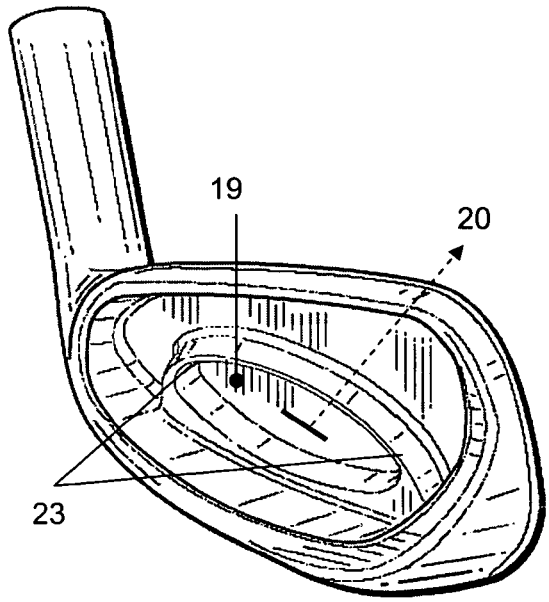
FIG. 7 is another perspective view of the golf club head shown in FIG. 1.
Figure 8:
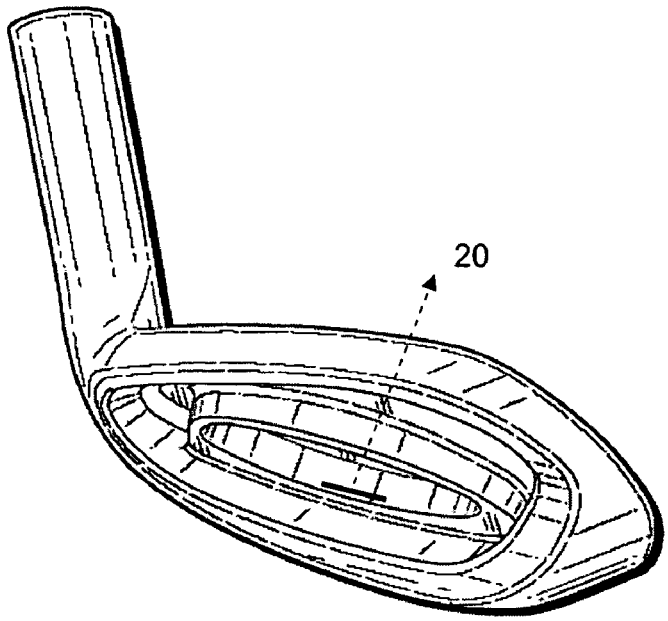
FIG. 8 is a perspective view of another golf club head according to the present invention.
Figure 9:
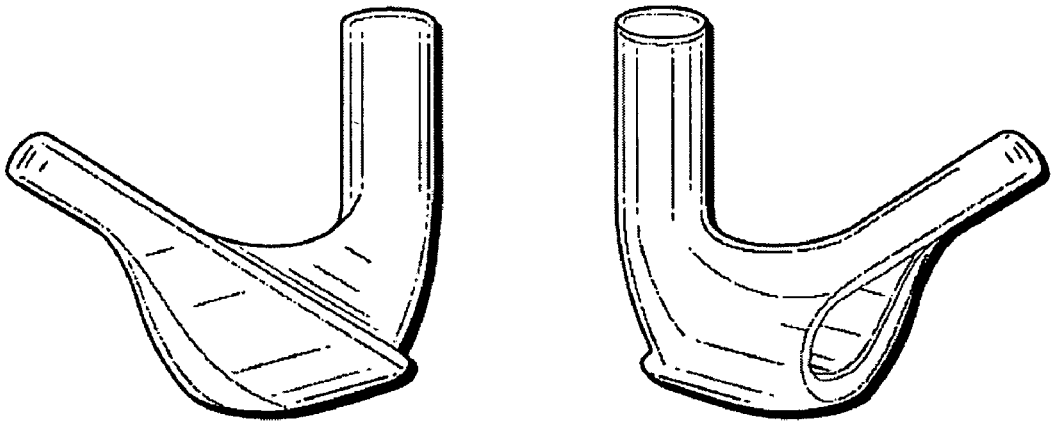
FIG. 9 includes heel and toe end views of the golf club head shown in FIG. 8.
Figure 10:
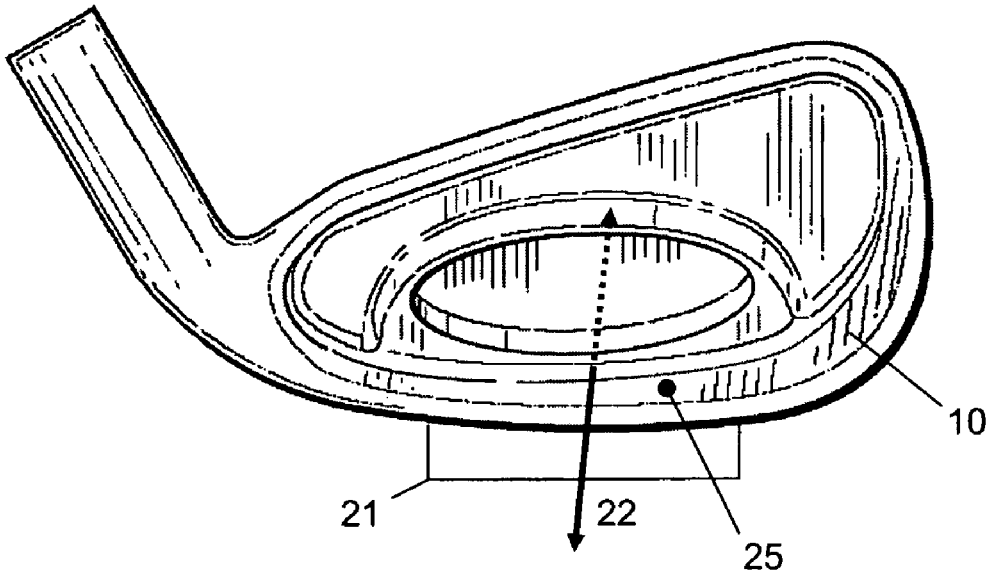
FIG. 10 is another rear elevational view (similar to FIG. 5) of the golf club head shown in FIG. 1.
Figure 11:
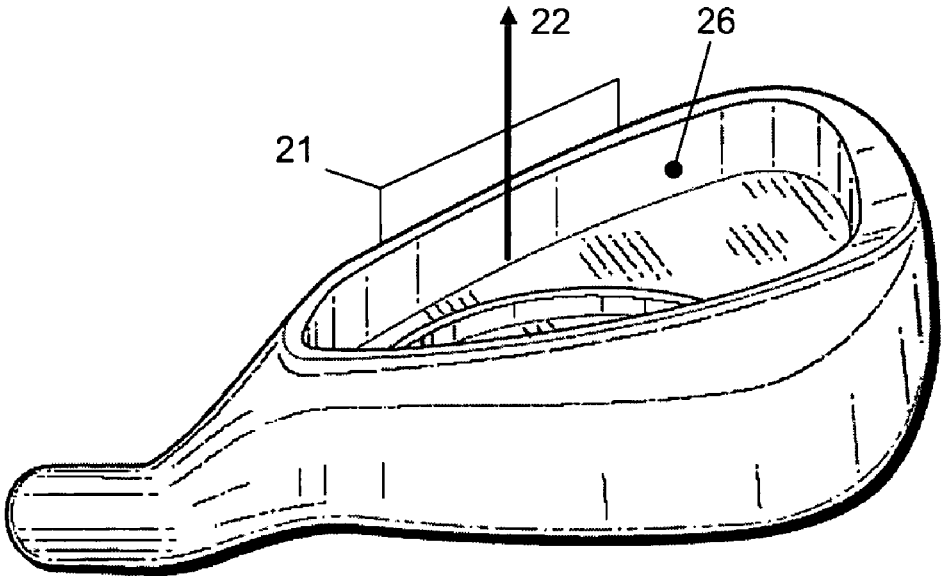
FIG. 11 is back perspective view of the golf club head shown in FIG. 1.

The golf club head 1 of the present invention comprises at least one secondary cavity 11 in its backside 7 with the secondary cavity 11 positioned within the primary cavity as disclosed in U.S. Pat. No. 6,206,790 to D. J. Kubica et al. The secondary cavity 11 is formed by at least one interior wall 12, which may, optionally, be integrally formed with the sole 10 of the club head. In certain preferred embodiments, the secondary cavity 11 is positioned above the sole 10 within the primary cavity, whereby mass concentrations 13 may be disposed between the secondary cavity 11 and sole 10. In certain preferred embodiments, the mass concentrations 13 that are disposed between the secondary cavity 11 and sole 10 consist of the same material that is used to construct the golf club head 1. In certain embodiments, such mass concentrations 13 form part of (and may be integrally formed with) the bottom segments 14 of the interior wall 12. One of the bottom segments 14 is located adjacent a heel end of the interior wall 12, and the other bottom segment 14 is located adjacent a toe end of the interior wall 12. In such embodiments, the mass concentrations 13 would preferably be disposed between the secondary cavity 11 and sole 10 by virtue of the interior wall 12 increasing in width as it approaches the sole 10 as seen in FIGS. 1 and 5.

In certain embodiments, the mass concentrations 13 between the secondary cavity 11 and sole 10 intersect and are integrally formed with the sole 10. It will be understood by those of ordinary skill in the art that such mass concentrations 13 may exhibit any number of contours, shapes and sizes. In certain preferred embodiments, the mass concentrations 13 are integral with or part of the bottom segment of the interior wall 12 while intersecting and being formed integrally with the sole 10. It should be understood by those skilled in the art, however, that in certain alternative embodiments such mass concentrations 13 do not intersect the sole 10.

In certain preferred embodiments, the invention provides that the interior wall 12, or segment thereof (such as the top segment of such interior wall 12), forming the secondary cavity 11 is substantially uniform in height 17. More particularly, the "height" 17 of the interior wall 12 refers to the approximate distance measured from the bottom wall 24 of the primary cavity to the outer surface of the interior wall 12 (i.e., the surface furthest from the bottom wall 24). In certain embodiments, the entire interior wall 12 is substantially uniform in height 17, whereas in other embodiments only a segment thereof is substantially uniform in height 17, such as the top segment of such interior wall 12 (i.e., the segment that is closest to the top rail 9).

In other embodiments, the top segment of the interior wall 12 is substantially uniform in width. In such embodiments, the "top segment of the wall," "top segment of the interior wall," or like phrases refers to that segment of the wall 12 which is generally closest to the top rail 9, such as the segment 23 identified in FIGS. 1 and 7. Of course, depending on the geometry of the secondary cavity 11 and golf club head 1, the top segment of the wall 23 may comprise different lengths, heights, widths, and other dimensions. Thus, the top segment of the wall 23 shown and described herein is provided for purpose of illustration only.

Still more specifically, referring to FIGS. 1 and 5, the top segment 23 of the interior wall 12, in certain embodiments, may be substantially uniform in width from its heel end 15 to its toe end 16. As shown, the top segment 23 of the interior wall 12 comprises a side that faces the inside of the secondary cavity 11 and a side that faces the interior of the primary cavity. The "width" of the top segment 23 of the interior wall 12, as used herein, refers to the approximate distance between the two sides that form the interior wall 12 (near its most distal surface, i.e., the surface most distant from the club face 6 and/or bottom wall 24).

The invention provides that the height and width of the interior wall 12 may vary depending on, among other factors, the size and dimensions of the club head 1, size and dimensions of the secondary cavity 11, and the loft of the club head 1. Thus, the invention should not be limited to a golf club head comprising an interior wall 12 having a particular height and/or width. Rather, the invention provides that the height 17 of the interior wall 12 (or segment thereof) is substantially uniform and, in certain embodiments, the width of such interior wall 12 (or segment thereof) is also substantially uniform from its heel end 15 to its toe end 16.

In certain embodiments, the approximate width of the interior wall 12 near its most distal surface may be less than the approximate width near the most proximate surface (i.e., the surface of the interior wall 12 closest to the club face 6). In certain alternative embodiments, the width of the interior wall 12 may be approximately uniform along the height 17 of the wall 12. The invention provides that, in certain embodiments, the width of the interior wall 12, along any particular location of its height 17, is substantially uniform from its heel end 15 to its toe end 16.

In certain preferred embodiments, the invention provides that the primary cavity is approximately parallel to the ground at normal address. More particularly, referring to FIG. 10, the approximate center portion 21 of the bottom rail 10 is approximately parallel to the ground at normal address. Still more particularly, in certain embodiments, an axis 22 running tangential to the surface 25 of the bottom rail 10 (near the approximate center of such rail 10) is approximately parallel to the ground at normal address. The invention provides that the surface 25 of the bottom rail 10 (and/or portion thereof, such as the center portion 21) is, preferably, approximately parallel to the ground at normal address. The invention further provides that other surfaces of the perimeter weight element 8 may, optionally, be approximately parallel to the ground at normal address. For example, the invention provides that the surface 26 of the top rail 9 may, optionally, be approximately parallel to the ground at normal address. More particularly, in certain embodiments, an axis 22 running tangential to the surface 26 of the top rail 9 (near the approximate center of such rail 9) may, optionally, be approximately parallel to the ground at normal address. Thus, for example, the invention provides that the surface 25 of the bottom rail 10, surface 26 of the top rail 9, other surfaces of the perimeter weight element 8, and/or any combination of the foregoing may be approximately parallel to the ground at normal address.

Figure 2:
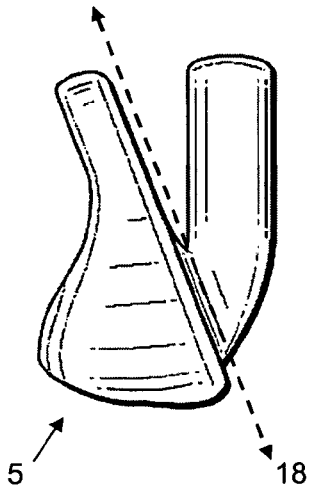
FIG. 2 is a toe end view of a the golf club head shown in FIG. 1.
Figure 3:
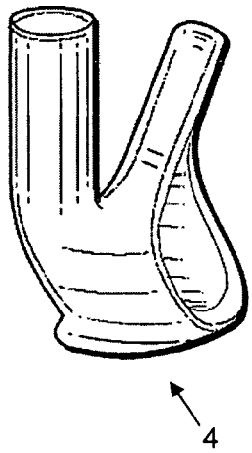
FIG. 3 is a heel end view of the golf club head shown in FIG. 1.
Figure 4:
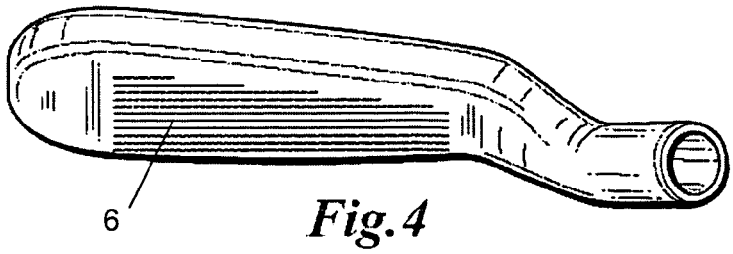
FIG. 4 is a top view of the golf club head shown in FIG. 1.

In certain preferred embodiments, the secondary cavity 11 has a bottom wall 19 that is approximately parallel to the plane 18 of the golf club face 6 (FIG. 2). More particularly, in certain embodiments, the plane of the bottom wall 19 of the secondary cavity 11 is approximately parallel the plane 18 of the golf club face 6. For example, referring to FIGS. 2, 7 and 8, in certain preferred embodiments, an axis running tangential to the bottom wall 19 of the secondary cavity 11 (i.e., the surface facing the interior of the secondary cavity) is approximately parallel to an axis running tangential to the plane 18 of the golf club face 6. To further illustrate such embodiments, referring to FIGS. 2, 7 and 8, an axis 20 running approximately perpendicular through the bottom wall 19 of the secondary cavity 11 would further run approximately perpendicular to the plane 18 of the golf club face 6. In such embodiments, the interior of the secondary cavity 11 (or the bottom wall 19 of the secondary cavity 11) is, preferably, approximately equal distance from the club face 6 at its heel and toe ends.

Still further, in certain related embodiments, the interior wall 12 is approximately perpendicular to the back wall 24 and/or plane 18 of the golf club face 6. More particularly, for example, an axis running tangential to the interior surface of the interior wall 12 (i.e., the surface facing the inside of the secondary cavity 11) is approximately perpendicular to the bottom wall 24 and/or plane 18 of the golf club face 6.

Preferably, the secondary cavity 11 is capable of receiving a weight adjustment member as disclosed in U.S. Pat. No. 6,206,790 to D. J. Kubica et al. The weight adjustment member (not shown) may comprise, for example, a substantially linear back-side, which is disposed within a cavity 11 in the backside 7 of the golf club head 1. In other embodiments, the weight adjustment members may comprise depressions, protrusions, or exhibit other geometries to accommodate the secondary cavity 11 and/or the golf club head 1. Of course, the exterior surface of the weight adjustment members may, optionally, comprise any number of shapes and designs, and are not limited to those shown and described herein.

Additionally, those of skill in the art will appreciate that the weight adjustment member (and corresponding secondary cavity 11) may, optionally, exhibit a plurality of shapes and sizes to provide for the different shaped club heads that comprise a set of golf clubs. In particular, because the club heads that comprise a set of golf clubs often vary in, among other things, size, loft, and perimeter weighting, the size, shape and geometry of the weight adjustment members (and corresponding secondary cavity 11) may be designed to accommodate for such variability in club heads in a set of golf clubs. Still further, the weight adjustment members may exhibit a plurality of different weights and densities. The weight and/or density of the weight adjustment members may be designed to affect any number of attributes of the club head, namely, swing weight, vibration absorption capacity, and center of gravity location. The weight adjustment members of the present invention may be disposed and secured within the secondary cavity 11 using any suitable adhesive, such as epoxy, or adhesive tape.

The golf club head of the present invention may be constructed of any material known in the art to be useful in making iron-type golf club heads. Furthermore, the iron-type golf club head of the present invention is not restricted to specific iron heads or the head designs shown and described herein. For example, the golf club head of the present invention may exhibit any degree loft, which includes a 1-iron or 2-iron through any type of wedge.

What is claimed is:

1. An iron-type golf club head comprising:

a body having a backside which includes a primary cavity, wherein the primary cavity is formed by at least one perimeter weighting element and wherein the primary cavity has a bottom wall; and a secondary cavity formed by an interior wall positioned within the primary cavity and in contact with the bottom wall thereof, wherein the interior wall has heel and toe ends, wherein the interior wall is approximately uniform in height between its heel and toe ends when measured from the bottom wall of the primary cavity while increasing in width near its heel and toe ends in order to form mass concentrations adjacent its heel and toe ends.

2. The golf club head of claim 1, farther comprising a sole and wherein the secondary cavity is positioned above the sole.

3. The golf club head of claim 2, wherein the interior wall comprises a top segment and a pair of bottom segments, wherein one of the bottom segments is located adjacent the heel end of the interior wall and wherein the other bottom segment is located adjacent the toe end of the interior wall, wherein each bottom segment increases in width as it approaches the sole.

4. The golf club head of claim 3, wherein each bottom segment of the interior wall is integrally formed with the sole.

5. The golf club head of claim 3, wherein the top segment of the interior wall is approximately uniform in width.

6. The golf club head of claim 3, wherein the top segment of the interior wall has a curvilinear shape.

7. The golf club head of claim 6, wherein the bottom segments of the interior wall are disposed at opposite ends of said curvilinear.

8. The golf club head of claim 7, wherein the secondary cavity has an elliptical shape.

9. The golf club head of claim 2, wherein the mass concentrations are disposed near the intersections of the interior wall and the sole.

10. The golf club head of claim 9, wherein the mass concentrations are formed integrally with the wall, the sole and the bottom wall of the primary cavity.

11. An iron-type golf club head comprising:

a body having a backside which includes a sole and a primary cavity, wherein the primary cavity has a bottom wall, wherein the primary cavity is formed by at least one perimeter weighting element; and a secondary cavity positioned above the sole, wherein the secondary cavity is formed by an interior wall positioned within the primary cavity in contact with the bottom wall thereof, wherein the interior wall has heel and toe ends, wherein the interior wall is approximately uniform in height between its heel and toe ends when measured from the bottom wall of the primary cavity and includes (i) a top segment which is approximately uniform in width and (ii) a pair of bottom segments located at opposite ends of the top segment which are integrally formed with the sole and increase in width as they approach the sole.

12. An iron-type golf club head comprising:

a front face;

a primary cavity formed by at least one perimeter weighting element, wherein the primary cavity has a bottom wall, wherein the perimeter weighting element includes at least one top rail and at least one bottom rail, wherein the bottom rail comprises a surface that faces the interior of the primary cavity, wherein the surface is approximately parallel to the ground when the golf club head is resting at normal address; and a secondary cavity formed by an interior wall positioned within the primary cavity in contact with the bottom wall thereof, wherein the interior wall has heel and toe ends, wherein the interior wall is approximately uniform in height between its heel and toe ends when measured from the bottom wall of the primary cavity while increasing in width near its heel and toe ends, and wherein the secondary cavity has a bottom wall that is approximately parallel to the plane of the front face.

13. The golf club head of claim 12, wherein the interior wall comprises a top segment and a pair of bottom segments, wherein the top segment is approximately uniform in width.

14. The golf club head of claim 13, wherein each of the bottom segments increases in width as it approaches the bottom rail.

15. The golf club head of claim 14, wherein each of the bottom segments is integrally formed with the bottom rail.

16. The golf club head of claim 14, wherein the top segment of the interior wall has a curvilinear shape.

17. The golf club head of claim 16, wherein the bottom segments of the interior wall are disposed at opposite ends of said curvilinear shape.

18. The golf club head of claim 17, wherein the secondary cavity has an elliptical shape.

19. The golf club head of claim 12, wherein the interior wall is approximately perpendicular to the front face.

20. The golf club head of claim 12, wherein the top rail comprises a surface which faces the interior of the primary cavity and which is approximately parallel to the ground when the golf club head is resting at normal address.

* * * * *